US005341531A

United States Patent [19]

Straub et al.

[11] Patent Number: 5,341,531

[45] Date of Patent: Aug. 30, 1994

[54] BOLSTER STRUCTURE FOR INFANT SIDE SLEEPING SUPPORT

[76] Inventors: Mariann C. Straub, 636 S. Belmont, Arlington Heights, Ill. 60005; Mark H. Greenwood, 702 S. Mitchell, Arlington Heights, Ill. 60005

[21] Appl. No.: 111,139

[22] Filed: Aug. 24, 1993

Related U.S. Application Data

[63] Continuation-in-part of Des. Ser. No. 8,056, May 6, 1993.

[51] Int. Cl.[5] ..... A47D 15/00

[52] U.S. Cl. ..... 5/655; 5/922

[58] Field of Search ..... 5/655, 632, 424, 425, 5/630, 465, 922

[56] References Cited

U.S. PATENT DOCUMENTS

| | | | |
|---|---|---|---|
| D. 343,756 | 2/1994 | Sher | 5/655 |
| 2,562,725 | 7/1951 | Leto et al. . | |
| 3,924,282 | 12/1975 | Bond | 5/632 |
| 4,506,396 | 3/1985 | Ritchie, Jr. et al. | 5/631 |
| 4,733,836 | 3/1988 | Barnes | 5/639 |
| 4,771,493 | 9/1988 | Park . | |
| 4,862,535 | 9/1989 | Roberts | 5/655 |
| 5,189,748 | 3/1993 | Garrison et al. | 5/655 |
| 5,193,238 | 3/1993 | Clute | 5/655 |
| 5,272,780 | 12/1993 | Clute | 5/655 |

*Primary Examiner*—Alexander Grosz
*Attorney, Agent, or Firm*—Olson & Hierl, Ltd.

[57] ABSTRACT

A bolster structure for infant side sleeping support and positioning having a rectangular apron to which a first pillow is secured along and adjacent one end thereof. A second pillow is preferably provided which is independently demountably associated with the apron in various orientations with hook and loop fastening means.

8 Claims, 4 Drawing Sheets

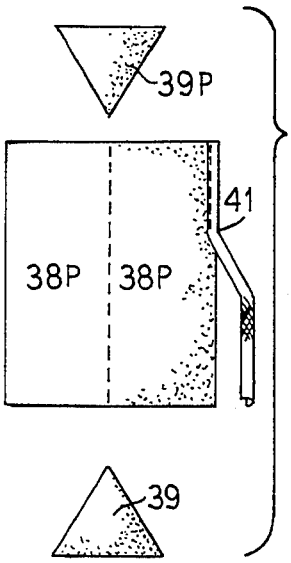
FIG. 2
FIG. 3
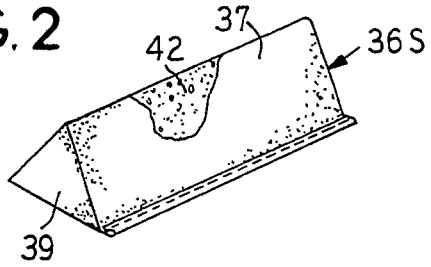
FIG. 5
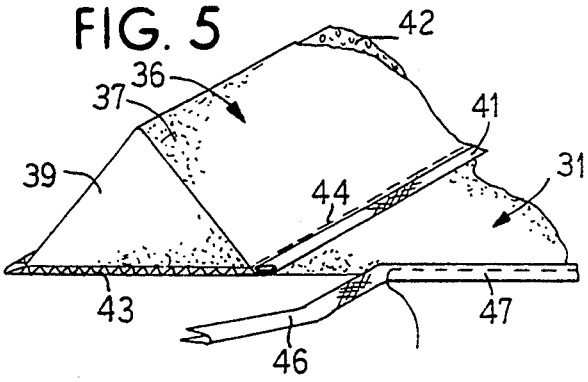
FIG. 4
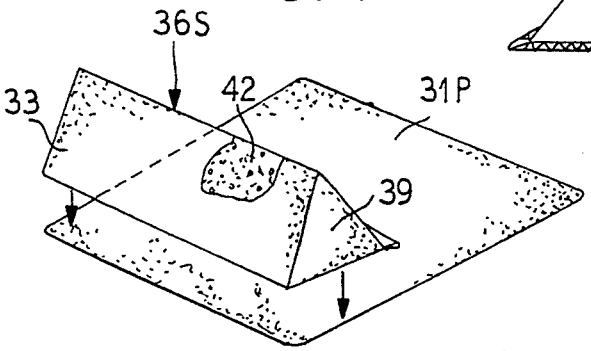
FIG. 6
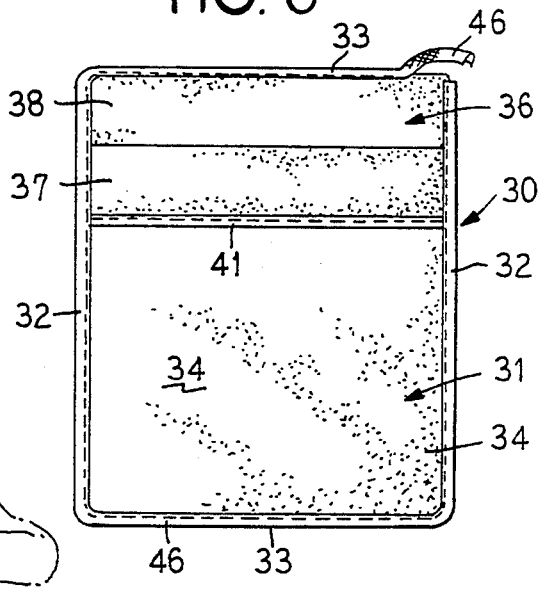
FIG. 1
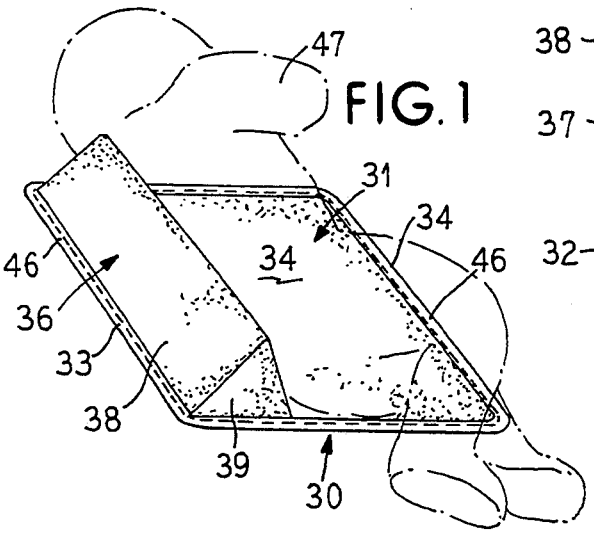

FIG. 13
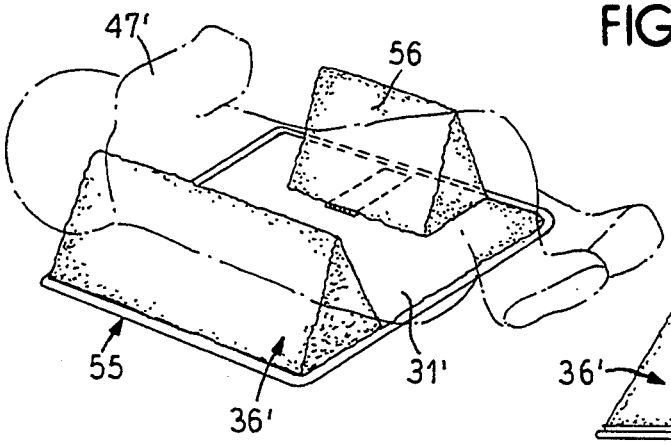
FIG. 19
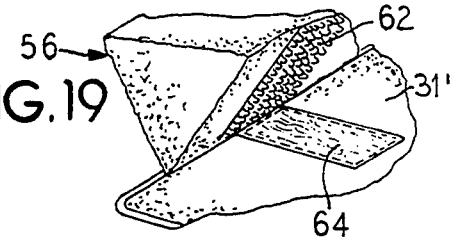
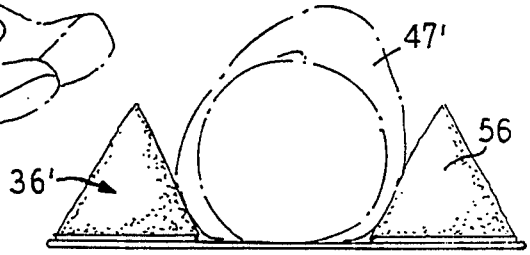
FIG. 14
FIG. 21
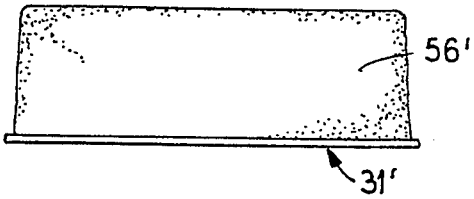
FIG. 23
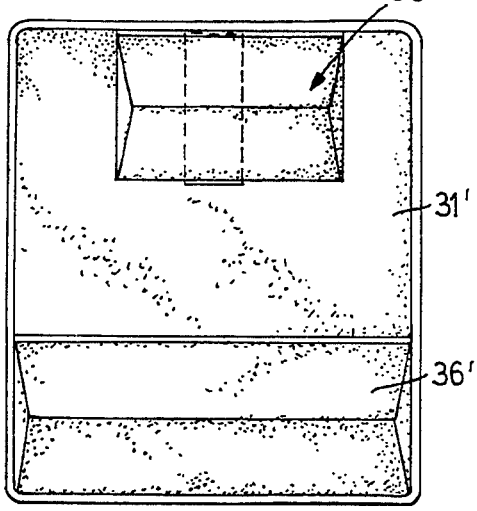
FIG. 24
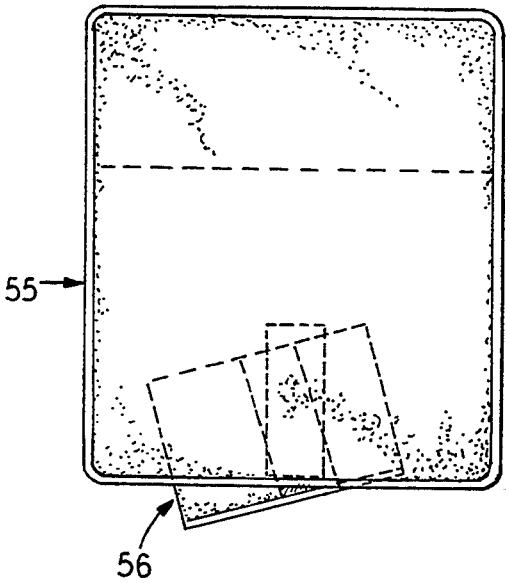
FIG. 22
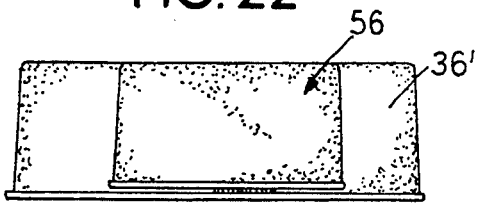

FIG. 15
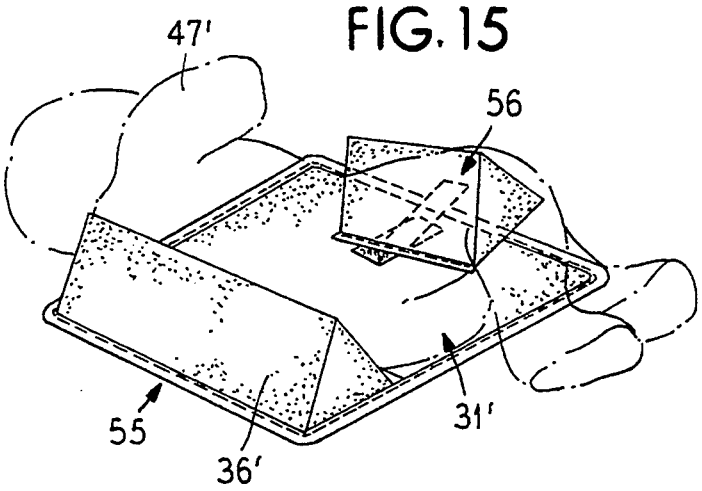
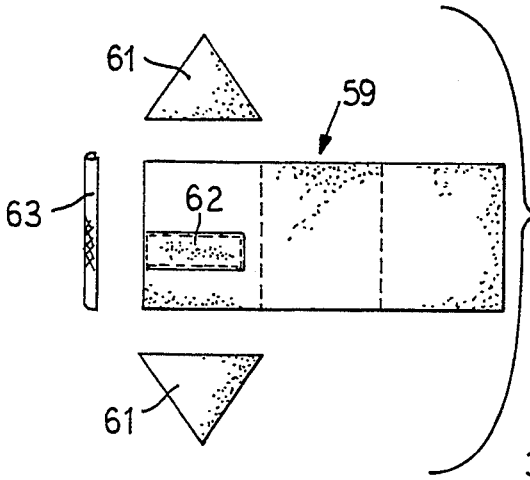
FIG. 16
FIG. 17
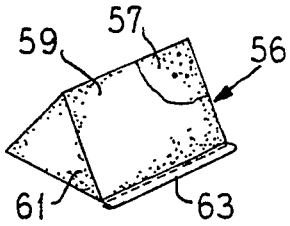
FIG. 20
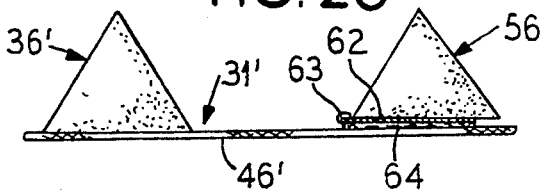
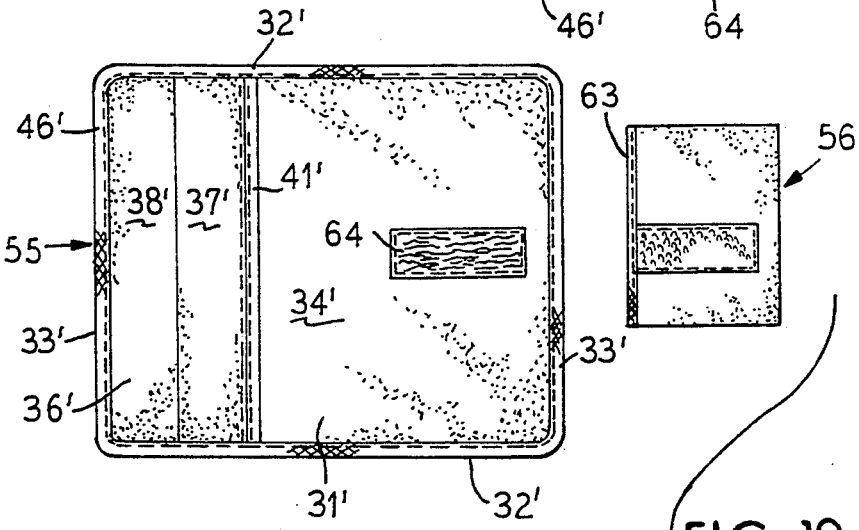
FIG. 18

BOLSTER STRUCTURE FOR INFANT SIDE SLEEPING SUPPORT

RELATED APPLICATION

This application is a continuation-in-part of our earlier filed U.S. Design application Ser. No. 29/008,056 filed May 6, 1993.

FIELD OF THE INVENTION

This invention relates to bolster structure for supporting a sleeping infant on its side.

BACKGROUND OF THE INVENTION

Medical literature has recently indicated that infants who sleep on their sides have a reduced risk of dying from Sudden Infant Death Syndrome compared to infants who sleep on their stomachs (according to a study published by the American Academy of Pediatrics during June 1992).

Also, an infant who sleeps on its back may be at risk because of the danger of formula regurgitation and liquid aspiration into lungs. It is theorized that up to about six months of age the motor skills of an infant may not be sufficiently developed to regulate movements responsive to certain breathing problems that may occur during sleep.

A rolled blanket placed behind the back of an infant is unsatisfactory for infant side support because the blanket may unroll. A structure is needed to support an infant on its side while sleeping. This invention provides such a structure.

SUMMARY OF THE INVENTION

This invention is directed to a bolster structure for infant side sleeping support and positioning. The structure utilizes a back support pillow that is fixedly associated with one side of a body supporting apron.

In a preferred embodiment, a second pillow is releasably associatable with an opposite side of the apron in various positions and orientations for front support. Such releasable association is achieved by hook and loop type fastening means.

One important feature and advantage of the present bolster structure is that it is fabricated of minimal amounts of component cloth or cloth-like materials and cushioning materials yet is readily and economically manufactured. The bolster structure is, nevertheless, durable and long lasting. If desired, it can be cleaned by a conventional water washing procedure when soiled. Alternatively, it can be discarded and replaced by a new bolster structure. The washability is facilitated by the fact that the use of minimal fabrication materials facilitates washing and relatively rapid air drying.

Another important feature and advantage is that a preferred embodiment of the bolster structure permits one of a pair of pillows to be placed on, and releasably associated with, the apron in various positions and orientations relative to the other pillow, thereby to enhance capability for infant support. However, the bolster structure can be used for infant side support with only one pillow, if desired.

Another feature is the provision of an infant side sleeper which incorporates two triangularly configured pillows and a single apron. The combination enhances infant support capability yet provides versatility with a first pillow having a fixed location relative to the apron and a second pillow, which is smaller than the first pillow, being variously positionable. Not only can the same side sleeper be used for infant positioning in many different ways, but also the same side sleeper can be used as an infant grows and develops.

A present preference is to construct a bolster structure of this invention of terry cloth, polyurethane foam, polyester binding tape and stitching.

Other and further objects, aims, features, advantages, purposes, embodiments, variations and the like will be apparent to those skilled in the art from the present description and associated drawings.

BRIEF DESCRIPTION OF THE DRAWINGS

In the drawings:

FIG. 1 is a perspective view of one embodiment of a single pillow type bolster structure of the present invention (showing in phantom an infant lying on its left side and supported by this structure);

FIG. 2 is a plan view of fabric components arranged for pillow cover fabrication in a first step of one method of making the bolster structure of FIG. 1;

FIG. 3 is a perspective view of the top portions of the pillow as partially assembled from the components shown in FIG. 2 in combination with a foam insert;

FIG. 4 is a perspective exploded view of the step of assembling the partial pillow assembly of FIG. 3 with the apron;

FIG. 5 is an enlarged, fragmentary view of the apron and pillow assembly with partially associated binding tape;

FIG. 6 is a plan view of the bolster structure of FIG. 1 in a final fabrication stage;

FIG. 13 is a perspective view of another embodiment of a double pillow type bolster structure of the present invention (showing in phantom an infant lying on its left side supported by this structure);

FIG. 14 is a head end elevational view of the bolster structure shown in FIG. 13 (showing in phantom the same supported infant of FIG. 13);

FIG. 15 is a view similar to FIG. 13 but showing the second pillow rearranged in its association with the bolster structure for improved infant side support and comfort;

FIG. 16 is an exploded view of the fabric components and hood and eye fastener component employed in the fabrication of the second pillow;

FIG. 17 is a perspective view of the second pillow as fabricated from the components of FIG. 16 and in combination with a foam insert;

FIG. 18 is a plan view of the assembly of first pillow and apron adjacent the second pillow illustrating one set of locations for the hook and loop fastening strips;

FIG. 19 is a fragmentary perspective view of the second pillow structure of FIG. 18 being associated with the apron of FIG. 18 through the interengagement of the hook and loop type fastening strips;

FIG. 20 is a side elevational view of the bolster structure embodiment of FIG. 18 after the second pillow has been associated therewith in the manner illustrated in FIG. 19;

FIG. 21 is a right side (relative to the infant shown in phantom in FIG. 13) elevational view of the embodiment shown in FIG. 13;

FIG. 22 is a left side (relative to the infant shown in phantom in FIG. 13) elevational view of the embodiment shown in FIG. 13;

FIG. 23 is a top plan view of the embodiment shown in FIG. 13; and

FIG. 24 is a bottom plan view of the embodiment shown in FIG. 13 but with the second pillow positioned at a canted angle.

DETAILED DESCRIPTION

Figure 7:
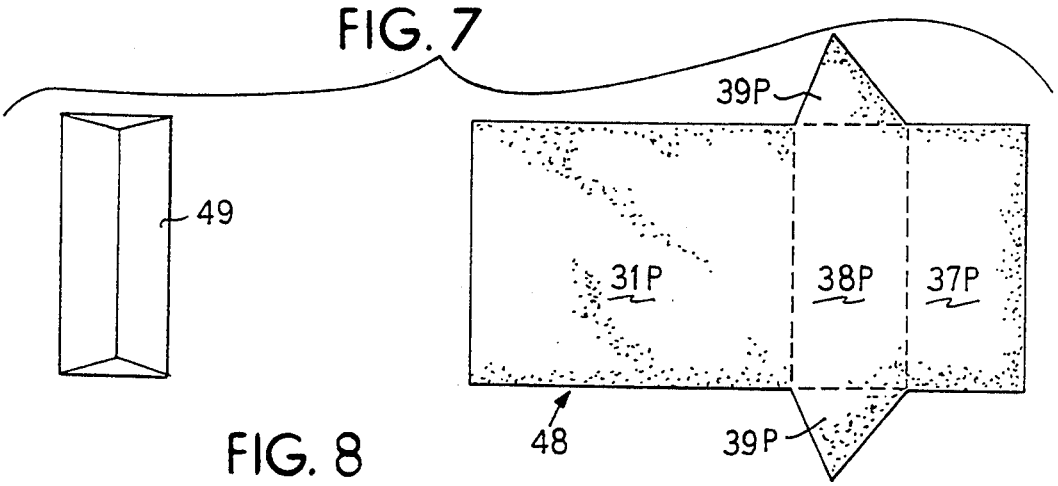
FIG. 7 is a plan view of the fabric component and the foam insert component used for an alternative method of fabricating the bolster structure of FIG. 1.
Figure 8:
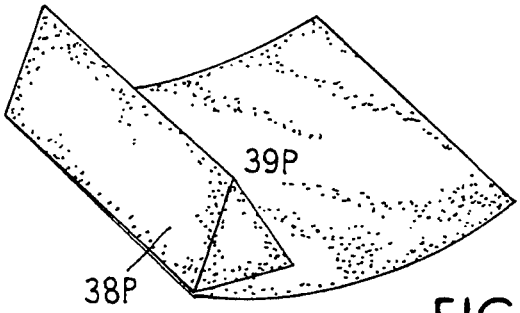
FIG. 8 is a perspective view of the partially assembled bolster structure of FIG. 1 as being fabricated from the components shown in FIG. 7.

Referring to the drawings, there is seen in FIG. 1 an embodiment 30 of a bolster structure of this invention.

The bolster structure 30 incorporates an apron or mat 31 that is comprised of a woven or non-woven fabric. A presently most preferred fabric is cotton terry cloth which offers advantages such as being soft, shock and liquid absorbent, non-slipping in surface texture, sewable, substantially non-allergenic, durable, conventionally washable, low cost, and the like, all of which make this material well suited for use with an infant. The apron 31 is preferably somewhat rectangular in shape with opposing pairs of side edges 32 and end edges 33 and an upper face 34 and a lower face (not shown in FIG. 1, but see, for example, FIG. 24 as described below).

The bolster structure 30 also incorporates a first pillow 36 which is elongated, resilient, elastomeric, compressible and shape-retaining. Pillow 36 rests on the upper face 34 and extends adjacent an end edge 33 between the side edges 33. In transverse (relative to pillow 36) cross-section, the pillow 36 preferably (and as shown) has the configuration of an equilateral triangle; however, other triangular configurations can be used, if desired.

Figure 12:
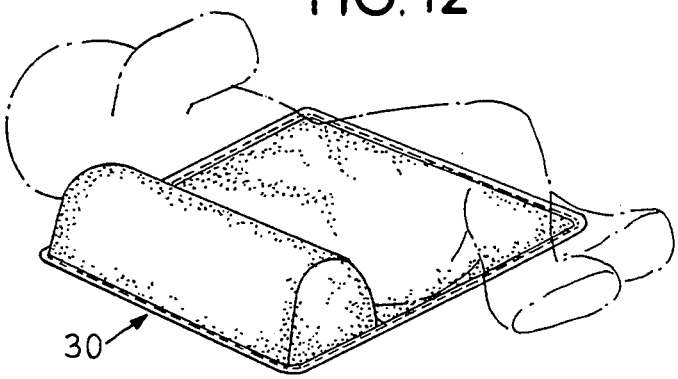
FIG. 12 is a view similar to FIG. 1, but illustrating a bolster structure of the invention which incorporates a pillow with an alternative cross-sectional configuration from that employed in the FIG. 1 structure.

Also, the pillow 36 can have alternative cross-sectional configurations, if desired, such as, for example, a hemi-circular or hemi-elliptical configuration such as shown in the bolster structure 30′ shown in FIG. 12. It is preferred to use a cross-sectional configuration for pillow 36 wherein the pillow base is flat in order to achieve a desired stable relationship with the apron 31.

The first pillow 36 is integral with, and permanently associated with, the apron 31. The exposed upper sides 37 and 38 and opposite ends 39 of pillow 36 are conveniently and preferably covered with the same or similar fabric material that is employed for the apron 31. Thus, the flat, elongated rectangular upper sides 37 and 38 of pillow 36, and the opposite ends 39 of pillow 36, are preferably covered with terry cloth. The ends 39 are preferably in spaced parallel relationship relative to each other.

The bolster structure 30 is preferably formed with a minimum amount of fabric for reasons of costs, simplicity and ease of maintenance (i.e., cleaning). Various techniques of fabrication can be used. One preferred technique is illustrated in FIGS. 2–6 (referred to herein for convenience as Technique I). Here, the fabric covering for the pillow upper sides 37 and 38 is precut as one piece 37/38P as are the separate fabric covering pieces 39P for each of the pillow ends 39, as shown in FIG. 1. Each of two sides of each of the end pieces 39P is stitched with a straight stitch or the like (not detailed) to a different one half end edge of the piece 37/38P. Also, one side edge of the piece 37/38P is stitched to a binding tape 41 with a straight stitch or the like, thereby to prevent that side edge from raveling in the completed bolster structure 30. Alternatively, such one side edge of the piece 37/38P can be turned under and stitched (in the next fabrication operation) to the apron 31 (not shown).

After the end pieces 39P are thus stitched to the opposite ends of the piece 37/38P, the resulting structure is turned inside out to position the seam overlaps internally, and the pillow fill 42 is inserted. The fill 42 can be comprised of various materials, as will be readily appreciated. Suitable fill materials include precut polyurethane foam (presently preferred), polyester fiber fill, and the like. When a polyurethane foam is used, a conventional hot water and detergent washing procedure for a bolster structure 30 may not be desirable because of the heat sensitivity associated with typical foams materials in common use. In bolster structure embodiment 30, a polyurethane foam fill 42 is preferably employed, and the resulting pillow subassembly 36S has an appearance as shown in FIG. 3.

This pillow subassembly 36S is then positioned as shown in FIG. 4 upon a precut fabric piece 31P for the apron 31 so as to be located along one end edge 33 and extend between the opposing side edges 32 (as shown by the arrows in FIG. 4). Adjoining respective three outside edges of the pillow subassembly 36S and the fabric piece 31P are then stitched together by a zig zag stitch 43 or the like as shown in FIG. 5. The remaining fourth edge of the pillow subassembly 36S is mounted to the apron 31 by a straight stitch 44 or the like.

Thereafter, conveniently commencing adjacent one corner of the apron 31, a binding tape 46 is stitched by a straight stitch 47 (see FIG. 5) or the like about the entire outside perimeter of the apron 31 to complete fabrication of the bolster structure 31. The binding tape 46 is employed to avoid raveling of the apron 31 and the covering of the pillow 36 and to enhance the desired layflat capability of the bolster structure 30. The binding tapes 41 and 46 can be comprised of a woven fabric such as a synthetic fabric comprised of polyester or the like.

The manner of using the bolster structure 36 to support an infant 47 (shown in phantom) in a side sleeping position is illustrated in FIG. 1. The weight of the infant on the apron 31 helps stabilize the infant's position with its back resting (i.e. supported) against the pillow 36.

Figure 9:
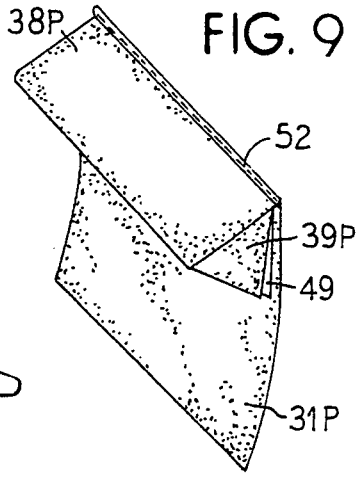
FIG. 9 is another perspective view of the partial assembly of FIG. 8, but with binding tape partially stitched about the assembly.
Figure 10:
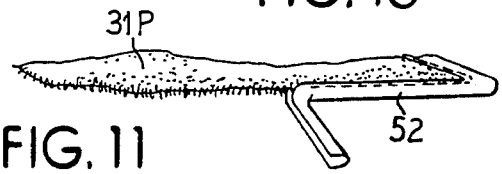
FIG. 10 is a fragmentary edge elevational view illustrating the further installation of the binding tape.
Figure 11:
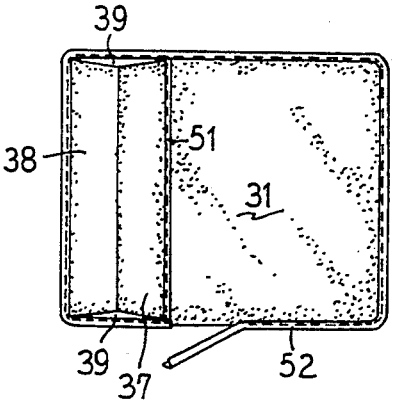
FIG. 11 is a plan view of the bolster structure of FIG. 1 in a final fabrication stage by the alternative fabrication method.

Another technique for the fabrication of the bolster structure 30 is illustrated in FIGS. 7–11 (referred to herein as Technique II). Here, the apron piece 31P, the side pieces 37 and 38P and the opposite end pieces 39 are formed from a single precut fabric piece 48 and a pillow fill 49 (preferably comprised of polyurethane foam). To form the pillow subassembly 36S, the opposite ends of the portion 37P of piece 48 are sewn to the adjacent respective side of each end piece portion 39P of piece 48 and then the pillow subassembly 36S is turned inside out and charged with the fill 49 at which time the resulting partial assembly has the appearance shown in FIG. 8. The interior (relative to apron 31) edge of the pillow subassembly 36S is preferably sewn to a binding tape 51 (see FIG. 11) and this edge is then stitched to the adjacent apron portion 31P of piece 48. Finally, beginning at one apron portion 31P corner (for example, a corner such as shown in FIG. 9), a binding tape 52 is stitched around the perimeter of the apron 31 as shown in FIG. 10 resulting finally in the bolster structure 30. The nearly completely stitched tape 52 is illustrated in FIG. 11.

As indicated above, an alternative of bolster structure embodiment 30' is shown in FIG. 12 which differs from embodiment 30 (see FIG. 1) by having different proportions and a different cross-sectional configuration for the pillow 36'. Such a bolster structure may be desirable when the infant body size is larger than illustrated, for example, in FIG. 1 in relation to bolster structure 30. In embodiment 30', similar parts are similarly numbered, but with the addition of prime marks for identification purposes.

Another embodiment 55 of a bolster structure of this invention is seen in FIGS. 13, 14 and 15. The bolster structure 55 is similar to the bolster structure 30 because it incorporates similar components which are similarly numerically identified, but with the addition of prime marks for identification purposes. Thus, bolster structure 55 incorporates an apron 31' and an incorporated, integrally associated first pillow 36'. With regard to apron 31' and pillow 36', the bolster structure 55 can be similarly fabricated by using Technique I or Technique II. Bolster structure 55 is preferably comprised of the same component material as bolster structure 30.

Bolster 55 utilizes a second pillow 56 which, like pillow 36' has an elongated, resilient, elastomeric compressible, shape-retaining second fill 57 (see FIG. 17). In transverse cross-section (relative to pillow 56) pillow 56 and fill 57 preferably have a triangular configuration, most preferably, the configuration of an equilateral triangle. Thus, when in a relaxed state, fill 57 preferably has three flat, elongated rectangular sides which are approximately equal to one another in surface area when the fill 57 cross-sectional configuration is that of an equilateral triangle, and fill 57 has a pair of triangular end walls which by present preference are in spaced parallel relationship to each other. Fill 57 can be comprised of various materials as in the case of fill 49, but a present preference is for the fill 57 to be comprised of the same material as the fill 49, (i.e., polyurethane foam).

Second pillow 56 has a length which is substantially shorter than the length of first pillow 36' so that second pillow 56 has a length which is substantially shorter than the transverse distance across the apron 31' between the side edges 32'. Preferably, the cross-sectional configuration and the cross-sectional size of the second pillow 56 are each about equal to those of the first pillow 36. A present preference is for pillow 56 to have a length which is about one half that of pillow 36'. As in the case of pillow 36, the pillow 56 can have other cross-sectional configurations.

The sides and the ends of the second pillow 56 are each covered by a fabric covering 58. The composition of covering can be, and preferably is, similar to that of the fabric material used for apron 31' and the covering for first pillow 36'. The presently preferred fabric is terry cloth. The second pillow 56 is an independent structure from apron 31' and first pillow 36'.

The second pillow 56, like the bolster structure 30 or 30' is preferably formed with a minimum amount of fabric for similar reasons. Various techniques of fabrication can be used. One preferred technique is illustrated in FIGS. 16–18. Here, the fabric covering 59 for the three sides of pillow 56 is precut as one piece and each of the triangular end coverings 61 is precut as a single piece. A hook and loop type fastening strip 62 is mounted by peripheral stitching about the strip 62 against an outside face of one side portion of covering 59 at one end thereof so as to extend across at least about 80% of the exterior width of one side of the resulting pillow 56. Each of the two sides of each of the end pieces 61 is stitch with a straight stitch or the like (not detailed) to a different pillow side edge in piece 59, preferably one such side edge being the pillow bottom side (whereon the strip 62 has been stitched) and the second such side edge being adjacent thereto. After the resulting structure is turned inside out and stuffed with the fill 57, the third pillow side end edges are joined (stitched) to the coverings 61. The flap overlap where the opposite ends of the covering join are stitched together and overcovered with a binding tape 63 that is stitched thereto (to prevent raveling).

Centrally between the opposite side edges 32' on the upper face 34' of apron 31' and commencing at a location in spaced, adjacent relationship to the end edge 33' that is opposed to the end edge 33' along which the pillow 36' extends a second hook and loop type fastening strip 64 is mounted by peripheral stitching about the strip 64. The length and width of the strip 64 are preferably about equal to the length and width of the strip 62.

The bolster structure 55 thus incorporates at least two elongated hook and loop interengaging fastener strips 62 and 64. Although stitching is preferred, any convenient mounting means for these strips can be used, including adhesive and the like. Preferably, the strip 27 is located in a mid-region of face 12 between side edges 15 and 16. Mounting means, such as stitching (preferred), adhesive, or the like is used to fasten the strip 27 to the face 12. The length of strip 27 is preferably equal to the transverse width of one side face of the second bolster 22. The exposed face of the strip 28 is interengagable with the exposed face of the strip 27.

Preferably, the strip 62 has an exposed face with a soft, looped structure while preferably strip 64 has an exposed face with a rougher or coarser hooked structure. While two interengagable hook and loop fastener strips are here employed, and are presently preferred, those skilled in the art will appreciate that many arrangements for such hook and loop fastener strips can be used rather than that of the arrangement shown.

In a presently preferred form of bolster structure 55, the pillow 36' has a length which is at least sufficient to extend the full length of an infant's torso. The other pillow 56, which is separatable from the apron '31 and is angularly orientable or positionable on the apron 31' relative to the pillow 36', preferably has a length which is not greater than about the torso distance between the outstretched arms and forwardly extended legs of the infant. Thus, the two pillows 36' and 56 can be positioned relative to one another in the manner shown, for example, in FIG. 13 to achieve infant side support.

One manner in which the pillow 56 is detachably associated with the apron 31' to produce the assembled configuration of the bolster structure embodiment shown in FIG. 13 is illustrated in FIGS. 18–20. Thus, as shown in FIG. 18, pillow 56, bottom side up, is first oriented spatially so that strip 64 is aligned with strip 62. Then, pillow 56 is pivoted on a base edge to bring the strips 62 and 64 together in face to face abutment as shown in FIG. 19, and the result is as illustrated in FIG. 20. Side and end elevational views of the resulting assembly are also shown in FIGS. 14, 21, 22 and a top plan view as shown in FIG. 23.

Pillow 56 can be detached from apron 31' and angularly reattached for better positioning and supporting of an infant 47' (the pillow 56 orientating choice perhaps depending upon the position of the infant). Another orientation for pillow 56 is shown in FIG. 24, for example.

Although the invention has been described with specific embodiments and examples, these teachings are not limited thereto, and modifications will occur to those skilled in the art without departing from the spirit and scope of this invention.

What is claimed is:

1. A bolster structure for infant side sleeping support and positioning comprising:

(a) a generally rectangular apron having an upper face and an opposed lower face, and opposing pairs of side and end edges;

(b) a first elongated pillow, said first pillow having:

a generally rectangular flat base and an elongated crest in spaced relationship to said base, cross-sectionally symmetrical side walls which generally decline in transverse width with increasing upward distance from said base to said crest, a size such that said base extends on said upper face between a portion of said opposed side edges and adjacent to one of said end edges a fill which defines the contours of said base, said sidewalls, and said crest, said fill being comprised of a resilient, elastomeric, compressible, shape-retaining material, and a covering which extends from said upper face over said fill and which includes means mounting said covering to adjacent portions of said apron;

(c) a second elongated pillow, said second pillow having:

a generally rectangular flat base and an elongated crest in spaced relationship to said base, cross-sectionally symmetrical side walls which generally decline in transverse width with increasing upward distance from said base to said crest, a size such that said base is substantially longitudinally shorter than said base of said first pillow, a fill which defines the contours of said base, said sidewalls, and said crest, said fill being comprised of resilient, elastomeric, compressible, shape-retaining material, and a covering for said fill including mounting means therefor;

(d) hook and loop fastener means associated with said base of said second pillow and with said upper face adjacent to the other one of said end edges so that said base of said second pillow is releasably engagable at various orientations with said upper face; and (e) said first and said second pillows each having a similar cross-sectional configuration, and said second pillow having a length which is substantially shorter than the length of said first pillow so that said second pillow has a length which is substantially shorter than the transverse distance across said apron between said side edges.

2. The bolster structure of claim 1 wherein the perimeter of said apron has a binding tape stitched thereto.

3. The bolster structure of claim 1 wherein said first and second pillows each have a triangular cross-sectional configuration.

4. The bolster structure of claim 3 wherein said cross-sectional configuration is approximately that of an equilateral triangle.

5. The bolster structure of claim 1 wherein said apron and said covering on each of said first and said second pillows is comprised of terry cloth and said mounting means comprises stitching.

6. A selectively arrangeable bolster couple structure for infant support and positioning comprising (a) a generally rectangular apron having an upper face and opposed lower face, and opposing pairs of side edges and end edges;

(b) a first elongated pillow, said first pillow having a generally rectangular flat base and an elongated crest in spaced relationship to said base, cross-sectionally symmetrical side walls which generally decline in transverse width with increasing upward distance from said base to said crest, a size such that said base extends on said upper face between a portion of said opposed side edges and adjacent to one of said end edges a fill which defines the contours of said base, said sidewalls, and said crest, said fill being comprised of a resilient, elastomeric, compressible, shape-retaining material, and a covering which extends from said upper face over said fill and which includes means mounting said covering to adjacent portions of said apron;

(c) a second elongated pillow, said second pillow having:

a generally rectangular flat base and an elongated crest in spaced relationship to said base, cross-sectionally symmetrical side walls which generally decline in transverse width with increasing upward distance from said base to said crest, a size such that said base is substantially longitudinally shorter than said base of said first pillow, a fill which defines the contours of said base, said sidewalls, and mid crest, said fill being comprised of a resilient, elastomeric, compressible, shape-retaining material, and a covering for said fill including mounting means therefor;

(d) hook and loop fastener means associated with said base of said second pillow and with said upper face adjacent to the other one of said end edges so that said base of said second pillow is releasably engagable at various orientations with said upper face; and (e) said first and said second pillows each having a similar cross-sectional configuration, and said second pillow having a length which is substantially shorter than the length of said first pillow so that said second pillow has a length which is substantially shorter than the transverse distance across said apron between said side edges.

7. The bolster structure of claim 6 wherein said cross-sectional configuration is approximately that of an equilateral triangle.

8. The bolster structure of claim 6 wherein said apron and said covering on each of said first and said second pillows is comprised of terry cloth and said mounting means comprises stitching.

* * * * *

UNITED STATES PATENT AND TRADEMARK OFFICE

CERTIFICATE OF CORRECTION

PATENT NO. : 5,341,531

DATED : August 30, 1994

INVENTOR(S) : Mariann C. Straub and Mark H. Greenwood

It is certified that error appears in the above-indentified patent and that said Letters Patent is hereby corrected as shown below:

Column 8, line 56, claim 6, "similar cross-sectional" should be --triangular cross-sectional--.

Signed and Sealed this

Twenty-seventh Day of December, 1994

*Attest:*

Bruce Lehman

BRUCE LEHMAN

*Attesting Officer*

*Commissioner of Patents and Trademarks*